US005400716A

United States Patent [19]

Mayer

[11] Patent Number: 5,400,716

[45] Date of Patent: Mar. 28, 1995

[54] DEFORMATION BULLET

[76] Inventor: Karl K. Mayer, Unterm Brehloh 38, 5760 Arnsberg, Germany

[21] Appl. No.: 687,878

[22] PCT Filed: Nov. 14, 1989

[86] PCT No.: PCT/EP89/01365

§ 371 Date: Jun. 3, 1991

§ 102(e) Date: Jun. 3, 1991

[87] PCT Pub. No.: WO90/05891

PCT Pub. Date: May 31, 1990

[30] Foreign Application Priority Data

Nov. 14, 1988 [DE] Germany ..... 38 38 584.8

[51] Int. Cl.[6] ..... F42B 12/34

[52] U.S. Cl. ..... 102/507; 102/517

[58] Field of Search ..... 29/1.2, 1.21, 1.22, 29/1.23; 102/439, 507, 508, 509, 510, 514, 515, 516, 517, 518

[56] References Cited

U.S. PATENT DOCUMENTS

| | | | |
|---|---|---|---|
| 1,730,871 | 10/1929 | Aronson | 102/509 |
| 2,891,298 | 6/1959 | Kaul | 29/1.21 |
| 3,003,420 | 10/1961 | Nosler . | |
| 3,282,214 | 11/1966 | Briscoe . | |
| 4,044,685 | 8/1977 | Avcin | 102/508 |
| 4,136,616 | 1/1979 | Schirneker | 102/510 |
| 4,742,776 | 5/1988 | Scuto . | |

FOREIGN PATENT DOCUMENTS

| | | | |
|---|---|---|---|
| 15574 | 9/1980 | European Pat. Off. . | |
| 869595 | 2/1942 | France | 102/507 |
| 1283366 | 12/1961 | France . | |
| 100541 | 10/1897 | Germany . | |
| 3840165 | 7/1990 | Germany | 102/510 |
| 527611 | 10/1940 | United Kingdom | 102/514 |
| 1038702 | 8/1966 | United Kingdom . | |

*Primary Examiner*—Harold J. Tudor
*Attorney, Agent, or Firm*—Henry M. Feiereisen

[57] ABSTRACT

A deformable hunting projectile has a one-piece body in the form of a turned red brass part with a tapering head part and a cylindrical guide part; a charge (7) of fine zinc or similar expansion agent is arranged in the head part and a charge of hard lead is arranged in the guide part. The charges are separated by a partition (13) formed in one piece from the body of the projectile, which is concave at the front and convex at the rear and therefore elastically deformable transversally. This, together with the deformability of the charges, permits good radial adaptation of the projectile to the barrel of a gun. The manufacture of the body of the projectile on a computer-controlled lathe ensures extremely precise concentricity of the charges with the outer surface. For use in propellant charge cartridges of various strengths, the projectiles can be manufactured with varying wall thicknesses of the head part. The wall thickness contour and hence the deformation behaviour of the projectile on impact can be established by suitable programming of the CNC lathe.

10 Claims, 4 Drawing Sheets

1.
2.
3.
4.
5.
6.
7.
8.
9.
10.
41
42
43
45
47
49
51
52
53

DEFORMATION BULLET

The invention relates to a deformation bullet with a one-piece bullet body which is made of tough-deformable material and includes a rear, generally cylindrical guide part and a front head part tapering toward the nose of the bullet, and with a charge made of easily deformable expanding material and arranged in a cavity of the head part which cavity extends concentric to the bullet axis and is open at the nose of the bullet, with the charge causing a peeling and expanding of the cavity-surrounding jacket of the head part upon impact.

Such deformation bullets are primarily used for hunting, and their effectiveness is based on the fact that upon impacting of the bullet in animal tissue, the bullet head mushrooms to thereby attain a great expansion of the entry channel of the bullet and an increased shock effect in order to accomplish a quick kill of the quarry. In contrast to so-called fragmentation bullets, the bullet not only retains its coherence and does not cause any fragmentation but also exits from the body of the quarry at enlarged exit hole in comparison to the entry hole.

The DE-OS 22 28 733 describes a hunting bullet of the above-stated type, with a bullet body which, except for the expansion material in the cylindrical cavity of the bullet nose is made of massive tombac. The tombac material can be made sufficiently hard in order to allow shaping on a lathe and to reduce deposits in the barrel of the firearm. However, a respectively hard material diminishes the ability to adapt to the inner contour of the barrel so that the interior ballistics of the bullet becomes impaired. Moreover, the charge of expansion material, which after opening of the bullet nose inevitably spreads in the animal body, still makes up an undesirably high share of the total weight of the bullet.

The DE-OS 36 38 721 discloses a deformation bullet, with a bullet body having a continuous recess extending from the nose to the flat bullet base and accommodating a rear core of lead and a front core of lead or of a material free of lead. An inner jacket surrounding the rear core is interlocked with the outer jacket by at least one depression to prevent the rear core from being forwardly propelled upon impact of the bullet. It is, however, questionable whether a form-fitting interlock of this kind can withstand the forces released on bullet impact and is sufficient to hold the rear lead core. Rather, an essentially complete fragmentation of this bullet could be expected.

U.S. Pat. No. 3,003,420 describes a so-called two-compartment-bullet which, however, is to be classified as a type of fragmentation bullet since about 40% of the mass, the entire lead charge (12) of the forward bullet compartment are lost in the body of the game as unequivocally shown in FIG. 4 of U.S. Pat. No. 3,003,420. Further, the mass distribution of the charges is unfavorable since the forward charge has a greater mass than the rearward charge. Moreover, the configuration of the partition between the forward and rearward bullet compartments results in an increased pressure within the barrel, leading to drawbacks when it comes to interior and exterior ballistics, and further to a disadvantageous prolongation of the bullet at nominal weight in comparison to other bullets, preferably the present invention.

The invention is based upon the invention to provide a deformation hunting bullet of the above-stated type which has improved interior ballistics and ensures the coherence of a major part of the bullet mass at superior deformation effect.

According to a further development of the invention, a method of making a bullet of this type is disclosed which provides the bullet with interior ballistics and terminal ballistics which are precisely pre-programmed and suited to the strength of the propellant charge used with the bullet.

This object is attained in accordance with the invention by a deformation bullet of the above-stated type which is characterized by a bullet body with a guide part having a cavity concentric to the bullet axis and containing a charge of heavy metal, and by a partition separating the cavities of the head part and the guide part and provided in one piece with the bullet body.

The arrangement of a charge of heavy metal, especially lead, provides the guide part of the bullet with a considerably improved transverse elasticity for adaptation to the barrel of the firearm compared to the conventional guide part of massive tombac, whereby the one-piece partition wall formed from the bullet body prevents a forward discharge of the heavy metal charge on impact of the bullet.

Preferably, the partition includes a concave or hollow cone-shaped configuration toward the bullet nose and a convex or conically protruding configuration toward the bullet base. This configuration of the partition ensures also that the partition itself retains a certain transverse elasticity and does not cause a significant transverse stiffening. Thus, the bullet has superior interior ballistics.

It is of particular advantage when the hollow conical or concave contour of the partition steadily changes into a respectively ogivally arched inner contour of the cavity of the head part, with this inner contour together with an also preferably ogive outer contour of the head part determining the decrease of the wall thickness of the head part toward the nose of the bullet. According to an advantageous further development of the invention, the wall thickness of the head part and thus the volume of the charge of expansion material accommodated in the head part can be suited to the intended terminal ballistics of the bullet i.e. to the strength of the propellent charge used with the bullet so that the units of ammunition which are provided with the bullet and have a same caliber but different propellent charges can have correspondingly differently dimensioned wall thicknesses in the head part of the bullet.

In accordance with a preferred method of the invention, a bullet is made by initially turning out on a lathe the rear cavity of the bullet guide part as cylindrical rearwardly open bore from of solid material of hard tombac, with formation of the conically or convexly projecting rear surface of the partition, and, at the same time, by shaping the entire outer surface of the workpiece along the entire bullet length in a cylindrical manner and in a manner precisely coaxially to the cavity. Subsequently, through turning, the forward cavity with ogive inner contour and the correspondingly conical or concavely hollowed forward surface of the partition are made to thereby attain a cylindrical preform of the bullet body. After charging the expansion material and the heavy metal in the forward and rearward cavity, the head part of the bullet, through radial cold forming, is reshaped into the ogive bullet nose while in the area of the bullet base the wall of the bullet body is reshaped also through cold forming in order to partly or completely close the lead-filled cavity.

The bullet body may preferably be made by means of a multistage computer-controlled lathe (CNC-lathe) so that successively performed working stages such as turning of the rearward cavity and then of the forward cavity will not extend the production time.

According to an alternative embodiment of the method according to the invention, the cylindrical preform of the bullet body is made through multistage cold forming i.e. extrusion of a blank of hard tombac.

Embodiments of the invention will now be described in more detail with reference to the drawing in which.

Figure 1:
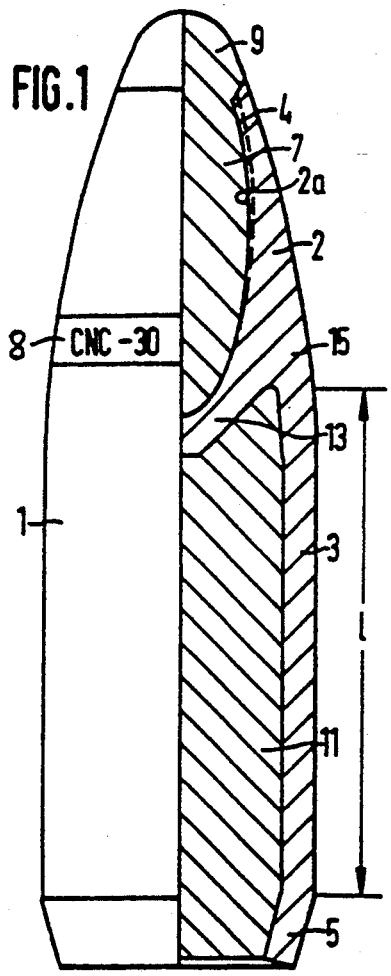
FIG. 1 is a longitudinal section of a bullet according to the invention.

The bullet shown in FIG. 1 includes a bullet body 1 which is made in one piece of hard tombac through turning and subsequent cold forming. The bullet body 1 forms over its length 1 a guide part 3 with cylindrical exterior, with rearwardly extending bullet base which can be cone-shaped or truncated cone-shaped, and with forwardly extending bullet head with ogive exterior which encloses a cavity open toward the bullet nose and containing a charge 7 which is made of expansion material, preferably nontoxic fine zinc alloy, lead or lead alloy and defines the rounded bullet nose 9. The weight of the charge 7 of expansion material amounts to less than 20%, preferably less than 10% of the overall weight of the bullet. In the area of the guide part 3, the bullet body has a cylindrical cavity which accommodates a charge 11 of heavy metal e.g. hard lead.

The forward and rearward cavity of the bullet body 1 are separated from each other by a partition 13 which is connected in one piece with the bullet body 1 and hollowed such as to project toward the bullet base in ogival-convex or conical manner and toward the bullet nose in ogival-concave or hollow conical manner. FIG. 1 illustrates a partition 13 being ogivally arched on both sides, with the transition area 15, in which the partition 13 meets the circumferential wall of the bullet body 1, being arranged further to the front than the center of the forward side of the partition 13. Thus, every radial section randomly laid through the bullet body 1 and the partition 13 is ring-shaped i.e. not solid. In this manner the partition 13 becomes elastically deformable in radial direction to thereby attain together with the deformability of the charges 7 and 11 a good deformability and adaptability when pushing the bullet into the barrel of the firearm, thus resulting in superior interior ballistics. At the same time, by being arched, the partition 13 can withstand the retarding forces exerted by the lead charge 11 on impact of the bullet so that a tearing of the partition 13 and a discharge of the lead charge 11 is definitely avoided.

In the embodiment of FIG. 1, the transition area 15 of the partition 13 is disposed in the circumferential jacket of the bullet body 1 approximately in the area where the cylindrical guide part 3 meets the bullet head part. Depending on the desired mass distribution of the charges 7 and 11, the partition 13 may be integral with the bullet body 1 further to the front or further to the rear, whereby the adaptation of the bullet to the barrel as ensured by the shape of the partition 13 is still retained.

In the area of the bullet head, the jacket 2 of the bullet body 1 has a wall thickness which continuously decreases toward the bullet nose so as to have an ogive inner configuration **2*a*. Arranged at the inner side of the jacket 2 are several e.g. four circumferentially spaced grooves 4 which act as desired breaking points when the bullet strikes a target and which allow the charge 7 being deformed to tear the jacket 2 open. This desired deformation behavior upon striking a target depends, on the one hand, on the thickness and shape of the jacket 2 and, on the other hand, on the impact velocity of the bullet which in turn is determined by the power of the used propellant charge. In accordance with the invention, different inner configurations 2*a* of the wall 2 allow adaptation of the terminal ballistics of the bullet to the power of the used propellant charge. A display 8** at the outer surface of the bullet allows indication of data about caliber as well as type of propellant charge for which the bullet was optimized.

Figure 2:
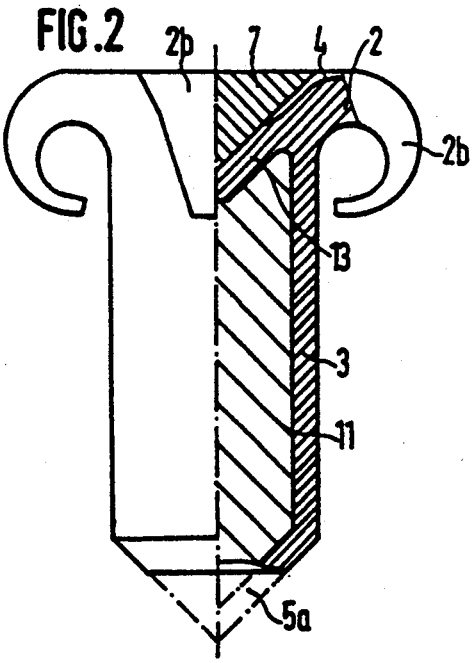
FIG. 2 is a longitudinal section of the deformed bullet upon impact.

FIG. 2 schematically shows the deformation occurring upon impact of the bullet according to FIG. 1. The radially expanding charge of expansion material tears open the jacket 2 of the bullet nose at the grooves 4, with the obtained segments or lugs being outwardly rolled in form of "ram horns" **2*b*. The partition 13 (shown of hollow conical shape here) remains intact so that the lead charge 11** remains completely enclosed.

Figure 3:
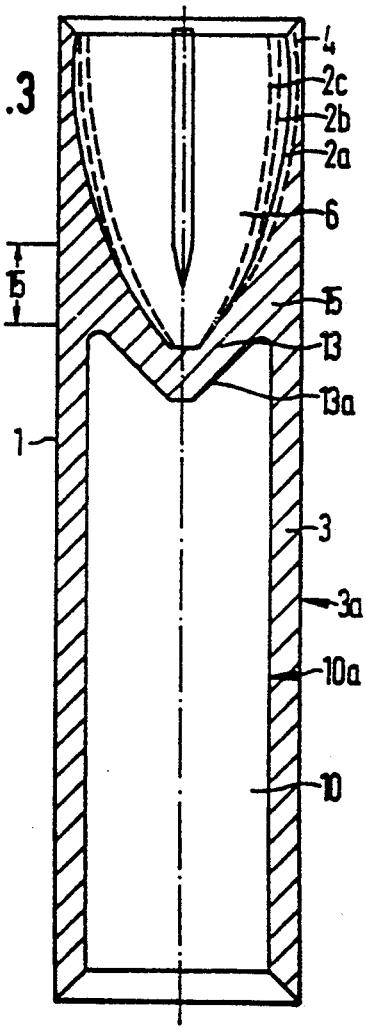
FIGS. 3 and 4 show a longitudinal section and a plan view of a bullet body which, before being charged, is made through turning.

FIG. 3 illustrates a semi-finished bullet body 1 in the shape in which it is made from tombac rod stock through turning on a preferably computer-controlled lathe. In a first working step, the cavity 10 of the guide part 3 is turned out, and at the same time the outer surface of the entire bullet body 1 is made so that a precise concentricity of the outer surface **3*a* and the inner surface 10*a* is ensured. Simultaneously, the rear surface 13*a* of the partition 13 is made which may be conically or ogival-convexly shaped. Preferably, this procedure is carried out in the main spindle of a CNC-lathe, preferably by using a high-gloss diamond tool at ultrahigh speeds. Already at this working stage, prior to formation of the cavity 6 of the bullet nose, the display 8** may be labelled with the type identification (caliber and strength of propellant charge), preferably through rolling embossing. Since the part to be turned is still massive in this area, the radial force impact acting thereupon will not cause deformations.

Figure 4:
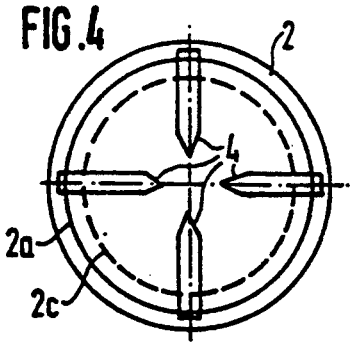

Subsequently, the cavity 6 of the bullet nose is made through turning on a lathe with an ogive inner contour, which may also be conically-pointed at the bottom, whereby varying inner contours **2*a*, 2*b*, 2*c* may be made in computer-controlled manner to best suit the wall thickness and thus the deformation behavior of the bullet to the respective strength of the propellant charge. Thereafter, the grooves 4 (compare FIG. 4**) which act as desired breaking points are made by means of a suitable tool e.g. long-hole milling cutter. By successively carrying out these working steps on simultaneously operating spindles of a multispindle CNC-lathe, the overall manufacturing time will not be prolonged.

After filling the front cavity 6 with the zinc charge 7 and the rear cavity 10 with the lead charge 11, the still cylindrical bullet body 1 as shown in FIG. 3 is shaped through radial cold forming into the configuration according to FIG. 1, with the bullet head 2 retaining its ogive exterior and essentially surrounding the zinc charge 7, while the bullet base 5 is partly closed in the shape of a truncated cone.

Modifications of the described embodiment are possible within the scope of the invention. As set forth above, the front and/or rear contour of the partition 13 can be cone-shaped or also configured in ogivally-curved manner. The partition 13 can be attached to the bullet further to the front or to the rear. The bullet base may be of conical shape instead of being configured in form of a truncated cone so that the heavy metal charge 11 is not exposed any more at the bullet base as indicated in dashdot line at 5*a* in FIG. 2. Instead of the grooves 4, the desired breaking points in the jacket of the bullet nose may be made also by configuring the inner contour 2 in the cross section of the bullet not as a circle but as a polygon. The outer contour of the bullet head 2 may be varied in such a manner that a conical or truncated cone shaped bullet nose or a round-headed type of bullet is attained.

Figure 5:
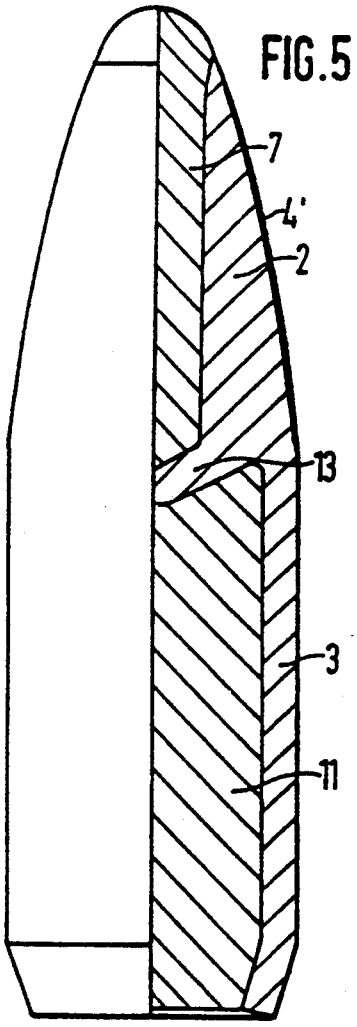
FIGS. 5 and 6 are longitudinal sections of two further embodiments of a bullet according to the invention.

FIG. 5 shows a modified embodiment of the bullet which differs from the embodiment according to FIG. 1 primarily in that the expansion material 7 containing cavity of the bullet nose 2 has an approximate cylindrical shape. Also, the concave-convex configuration of the partition 13 is less pronounced as in the embodiment according to FIG. 1. The grooves 4', which serve as desired breaking points for tearing up the jacket 2 of the bullet nose upon impact, are provided at the outside of the bullet nose in the embodiment according to FIG. 5. A particular advantage of this embodiment resides in the possibility to substitute the expansion material charge with a charge of heavy metal e.g. tungsten so as to obtain an armor-piercing bullet suitable for governmental use.

Figure 6:
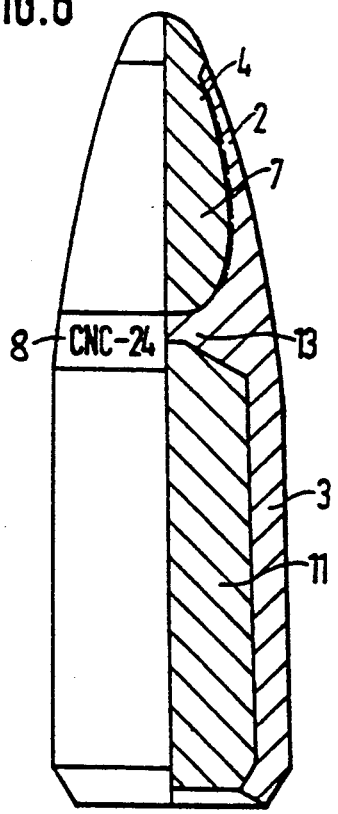

In the embodiment of FIG. 6, the partition 13 does not protrude toward the bullet base but is essentially of flat configuration. This embodiment is applicable as low-priced variation for small game.

Figure 7:
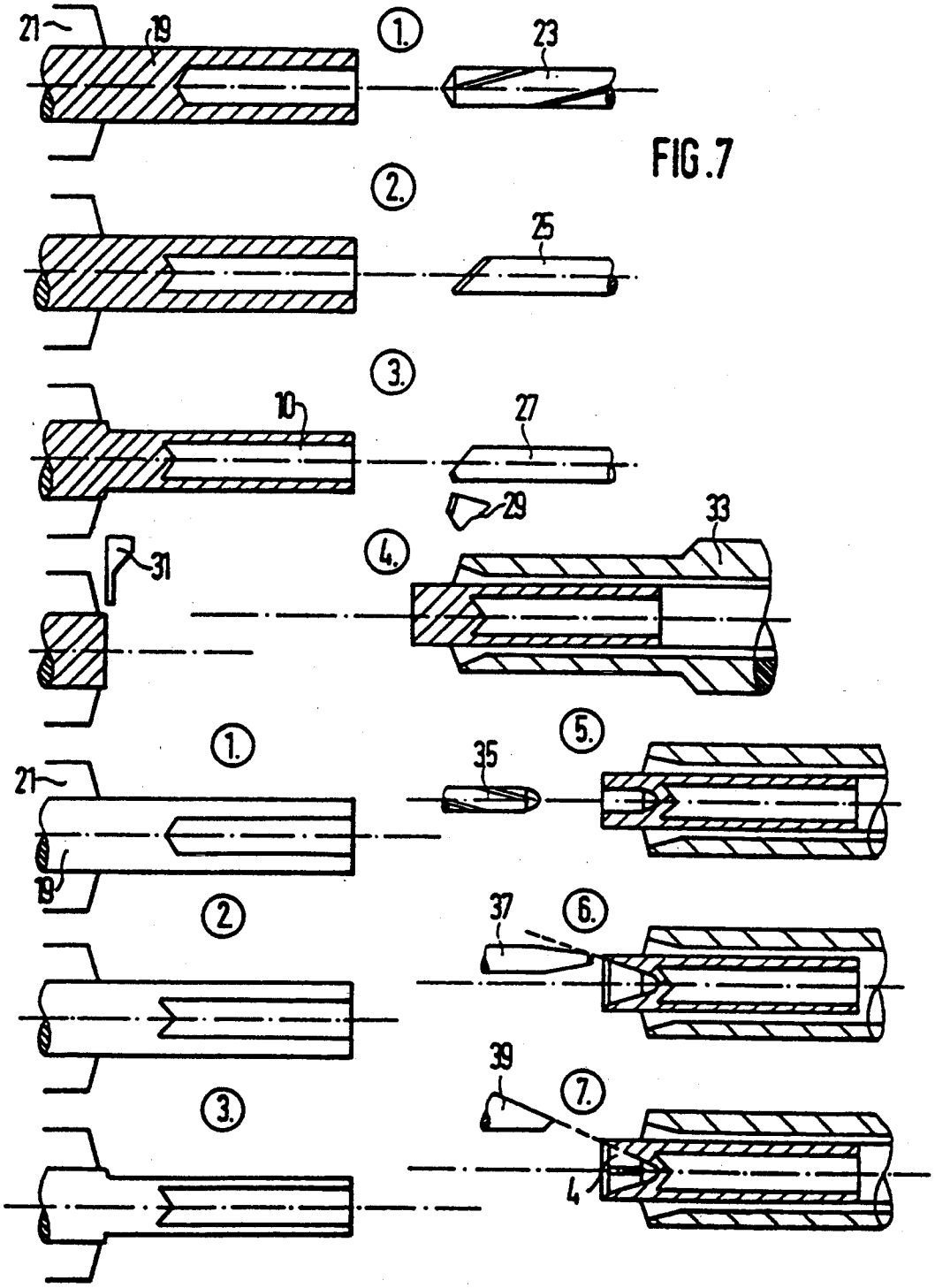
FIG. 7 is a schematic illustration of various working stages during shaping of the cylindrical preform of the bullet body.

FIG. 7 illustrates the making of a bullet body, with a rod-shaped workpiece 19 of hard tombac being clamped in the main spindle 21 of a CNC-lathe and cylindrically drilled with a drill 23 in working step 1. In working step 2, the base of the bore is made by a turning tool 25 to provide a conically protruding shape. In working step 3, the outer surface of the tombac rod and the circumferential surface of the bore are simultaneously shaped by high-gloss diamond lathe tools in order to make the finished cavity 10 of the guide part of the bullet body in precisely concentric configuration with the outer surface of the guide part. According to the fourth working step, the workpiece is cut away by a tool 31 from the rod stock and transferred to the synchronized spindle 33 of the second turret head of the lathe for roughly drilling in the fifth working step the cavity 6 of the bullet nose with a drill 35. In working step 6, the cavity is provided through turning with the desired, pre-programmed type of the inner contour e.g. ogival or also hollow conically shaped, and in working step 7, the grooves 4 which serve as desired breaking points are formed with a tool 39. While working steps 5 to 7 are carried out, the main spindle 21 can simultaneously perform working steps 1, 2 and 3 as described above on the suitably advanced rod stock 19.

The end result of step 7 yields the finished cylindrical preform of the bullet body which is then formed in a manner not shown in the drawing through radial deformation into the finished bullet configuration, after introducing the expansion material charge and the heavy metal charge.

Figure 8:
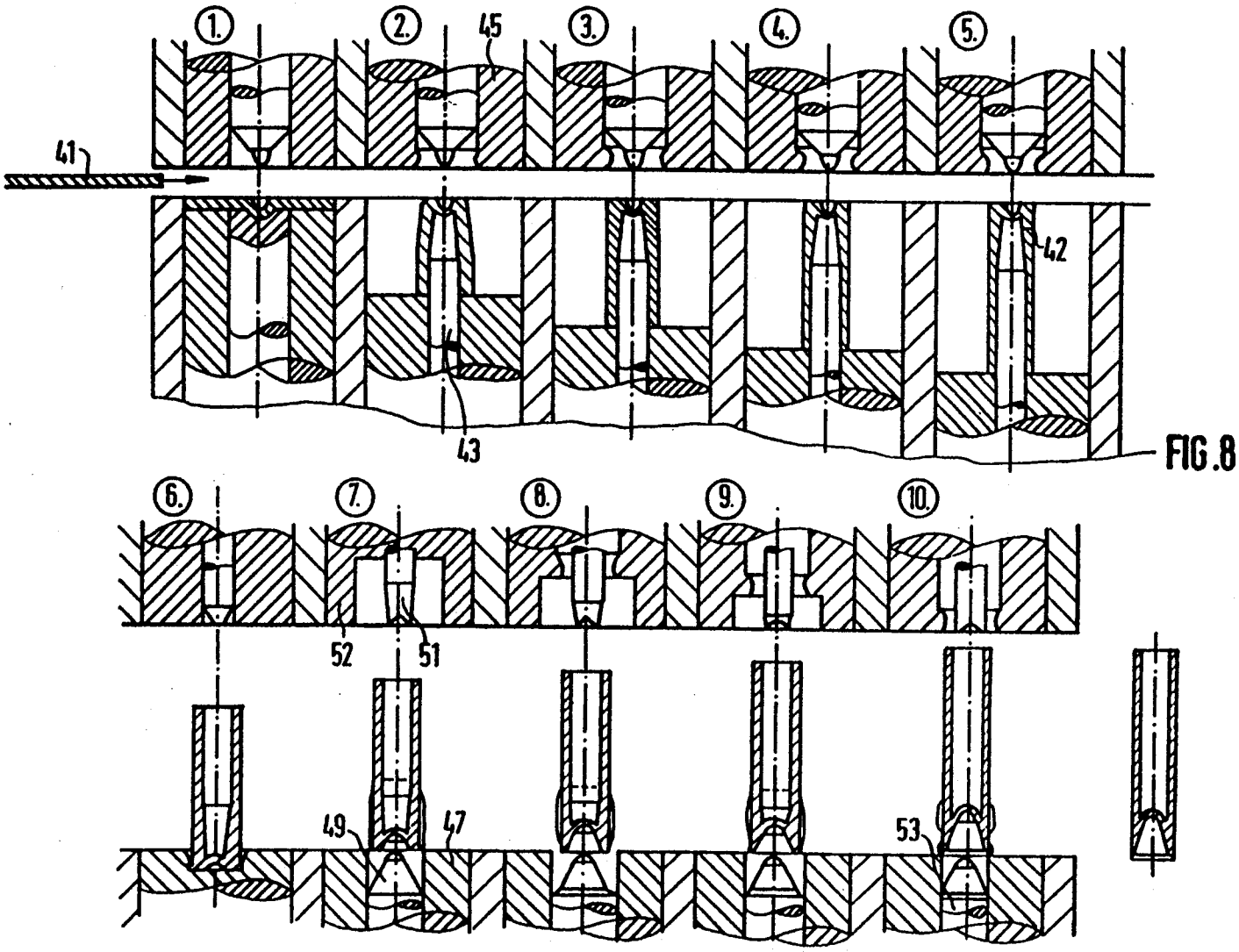
FIG. 8 is a respective illustration of the working stages during non-cutting shaping of the bullet body by means of cold forming.

FIG. 8 illustrates the making of the bullet body through cold forming, in which, like in the process as shown in FIG. 7, initially the area of the guide part and subsequently the area of the bullet nose are made. A flat blank 41 of tombac is introduced in a molding press for deep drawing or cold extrusion and provided initially in a first working step with a central concave-convex configuration. Thereafter, in steps 2 to 5 the deep drawing is continued by means of a mandrel 43 acting from below and an annular die 45 acting from above in order to create the guide part of the bullet body with the cavity 10 for the heavy metal charge, with a sufficient material accumulation 42 being retained at the upper end of the workpiece for shaping the bullet head. After working step 5, the workpiece is inverted and transferred to a second mold in which in working steps 6 to 10 the bullet body is finished in the area of the bullet head, essentially through cooperation of an annular die 47 and a conical or ogive inner die 49 which act from below and a mandrel-type die 51 which has a hollow cone shaped tip and acts from above. In working step 10, a die 53 is used which embosses the grooves 4 at the inner contour of the head part. As result, also a cylindrical preform of the bullet body is obtained.

I claim:

1. A deformation bullet, comprising:

a one-piece bullet body (1) defining an axis and including a cylindrical guide part (3) with a cavity (10) containing a charge (11) of heavy metal, and a tapering head part (2) connected to said guide part (3) and having a cavity (6) which contains a charge (7) made of deformable expansion material and projecting beyond said head part to form a nose (9); and a partition (13) provided in one piece with said bullet body (1) and having a concave shape toward said nose (9) and a convex shape toward said guide part (3) for separating said cavity (10) of said guide part (3) from said cavity (6) of said head part (2), said partition (13) having a front side which defines a midpoint lying on the axis of said bullet body, and being configured such that a transition area (15) is defined between said partition (13) and said bullet body (1) and extends in axial direction of said bullet body ahead of the midpoint of the front side of said partition (13).

2. A bullet as defined in claim 1 wherein said partition is of conical configuration.

3. A bullet as defined in claim 1 wherein the transition area (15) between said partition (13) and said bullet body (1) extends in the area of the tapering head part (2).

4. A bullet as defined in claim 1 wherein the cavity (6) of said head part (2) has an inner contour of ogive configuration.

5. A bullet as defined in claim 1 wherein said head part (2) has a wall thickness steadily decreasing toward said nose.

6. A bullet as defined in claim 1 wherein the charge (7) of expansion material in said cavity (6) of said head part (2) amounts to less than 20% of the overall weight of the bullet.

7. A bullet as defined in claim 1 wherein the charge (7) of expansion material in the cavity (6) of said head part (2) amounts to less than 10% of the overall weight of the bullet.

8. A bullet as defined in claim 1 wherein said bullet body (1) is made of tough hard tombac.

9. A bullet as defined in claim 1 wherein the charge of expansion material (7) An the cavity (6) of said head part (2) is selected from the group consisting of fine zinc, zinc alloy, lead and lead alloy.

10. A bullet as defined in claim 1 wherein the charge (11) in the cavity (10) of said guide part (3) is made of heavy lead.

* * * * *